US006383061B1

(12) United States Patent
Mandler

(10) Patent No.: US 6,383,061 B1
(45) Date of Patent: May 7, 2002

(54) PROCEDURE OF AND DEVICE FOR PROCESSING OPTICAL LENSES

(75) Inventor: Roland Mandler, Heuchelheim (DE)

(73) Assignee: OPTO-Tech GmbH, Wettenberg (DE)

( * ) Notice: Subject to any disclaimer, the term of this patent is extended or adjusted under 35 U.S.C. 154(b) by 0 days.

(21) Appl. No.: 09/351,907

(22) Filed: Jul. 14, 1999

Related U.S. Application Data

(62) Division of application No. 09/047,516, filed on Mar. 25, 1998, now Pat. No. 5,951,376.

(30) Foreign Application Priority Data

Mar. 26, 1997 (EP) ..... 97105089

(51) Int. Cl.[7] ..... B24B 1/00
(52) U.S. Cl. ..... 451/43; 451/42; 451/44
(58) Field of Search ..... 451/42, 43, 44

(56) References Cited

U.S. PATENT DOCUMENTS

| | | | | |
|---|---|---|---|---|
| 3,948,007 | A | | 4/1976 | Feneberg et al. |
| 4,598,502 | A | | 7/1986 | Lombard |
| 4,768,308 | A | | 9/1988 | Atkinson, III et al. |
| 5,149,337 | A | * | 9/1992 | Watanabe |
| 5,205,076 | A | | 4/1993 | Vernon et al. |
| 5,384,988 | A | | 1/1995 | Hernandez |
| 5,410,843 | A | | 5/1995 | Gottschald |
| 5,482,495 | A | * | 1/1996 | Mayahara et al. |
| 5,498,200 | A | | 3/1996 | Werner |
| 5,562,527 | A | | 10/1996 | Nauche |
| 5,577,950 | A | * | 11/1996 | Smith et al. |
| 5,720,649 | A | * | 2/1998 | Gerber et al. |
| 5,803,793 | A | | 9/1998 | Mizuno et al. |

FOREIGN PATENT DOCUMENTS

| | | |
|---|---|---|
| JP | 63037309 | 2/1988 |

* cited by examiner

*Primary Examiner*—Joseph J. Hail, III
*Assistant Examiner*—Willie Berry, Jr.
(74) *Attorney, Agent, or Firm*—Israel Gopstein

(57) ABSTRACT

For two-side processing of optical lenses, the invention provides that blanks to be used for each lens body (7) comprise a chucking extension (18) whereby a single machine is sufficient for implementing the procedure. In addition to workpiece spindles (1, 2) as well as tool spindles (4, 5) with coarse tools (8) and finishing tools (9), the machine also includes an unloading device (10) and a loading device (13) which in successive interacting operations take the lens body (7) when processed on one side and at the circumference from a chucking tool (12) of the tool spindle (1) and turn it round for centered insertion in its inverted position into a chucking tool (15) of the tool spindle (2) for processing on the other side. The workpiece spindles (1, 2) may be mounted parallel to each other on a horizontally displaceable and vertically adjustable feed slide (3). A feed carriage (6) may displace and slew the tool spindles (4, 5) together with the unloading device (10) around a horizontal B axis. The loading device (13) is slewable around a further horizontal axis (C) between the workpiece spindles (1, 2) and the tool spindles (4, 5).

14 Claims, 6 Drawing Sheets

PROCEDURE OF AND DEVICE FOR PROCESSING OPTICAL LENSES

This application is a Division of application Ser. No. 09/047,516 filed Mar. 25, 1998 U.S. Pat. No. 5,951,376.

TECHNICAL FIELD

The present invention relates to a procedure of processing optical lenses and to an apparatus for implementing such a process.

BACKGROUND ART

For the fabrication of lenses, hot-pressed glass blanks are normally processed. Such blanks have a shape of flat cylinder disks, or have faces which may be curved, depending on the desired shape for the lens to be produced. In the prior art, the glass blanks are first given the desired contour by means of grinding machines. A first device coarse-grinds the lens blank on one side and provides the blank with a polishable finishing surface in a second operation. The lens is then removed from the first device, turned around, and is also coarse-ground and precision-ground on the other side thereof by a second grinding machine. Then the lens is polished on both sides thereof in a third device. Finally, the rim of the thus polished lens is processed in a fourth device, a so-called centering machine.

The lens rim is provided with a precise circular geometry, possibly also with chamfers at the edges so as to give them a better shock resistance. During the centering operation, the lens is held between metal centering bells which align the lens so that its optical axis coincides with the rotating axis of the centering spindle. With unfavorable lens shapes, however, when there is no self-centering effect of the centering bells, the lenses have to be centered in a separate centering device by means of a light ray before they are cemented to a centering spindle, set into rotation by means of this spindle and ground at their outer rim in order that the optical axis of the lens coincides with its geometrical axis.

A disadvantage of the procedure employed by the prior art for manufacturing lenses is that two grinding machines and a centering machine are required, in addition to the polishing machine. This represents the most modern known technology and under the further assumption that coarse grinding and precision grinding of each side of the lens is already done in a single device. Nevertheless, a large amount of machinery is involved. Another disadvantage of the prior art is that by means of the metal tools used therein, e.g., the above noted centering bells, the polished lenses are chucked in the centering machine at their delicate polished surfaces, which thus may be easily damaged.

Moreover, it is disadvantageous that with the conventional procedure described above, each lens is chucked at its circumference which has only the quality and precision of a glass blank. When the first lens side has been finished, the lens is turned about as hereinabove described and rechucked in a second device. During this rechucking and centering at the still little precise circumference of the lens, undesirable inaccuracies and differences between the optical axes of the two lens sides may occur.

It is an important object of the present invention to manufacture lenses more cheaply and, at the same time, to increase the processing accuracy. Additionally, the proposed procedure and the device for its implementation aim at simplifying coarse grinding and precision grinding of the two lens sides as well as simplifying centering operations.

DISCLOSURE OF THE INVENTION

The present invention aims at overcoming these and other drawbacks of the prior art.

In accordance with the invention, in a method of processing optical lenses where a blank of a lens body is chucked and provided with a predefined contour by coarse and finishing tools through grinding and polishing operations, a lens body is provided with a chucking extension which permits and requires that only a single chucking operation be performed on the blank, the chucking extension being removed at the end of the process.

The inventive method is thus based on a novel geometry of the lens blank, of which a normal hot-pressed glass body will do whose shape can be varied with certain limits without the necessity of incurring appreciable extra cost. The new shape of the lens body differs from the previous standard shapes of lens blanks by including a chucking extension of, for example, a few millimeters height on one side of the lens body, which is thus set off to be noticeably smaller in diameter than the overall outer diameter of the lens body.

This basic shaping of the lens body makes it possible to carry out the aspects of the invention wherein coarse and precision processing of one side of the lens body is performed in one and the same chucking of the extension, whereupon the chucked lens body is turned around and processed on the back in the same single chucking position. During these operations, the optical axis of the lens and its geometrical axis will coincide substantially perfectly, as the lens body is chucked only once. Subsequent centering of the lens in a special centering machine is thus unnecessary since the lens is already centered when it leaves the first processing step.

In accordance with another aspect of the invention, the removal from a first chucking device and the insertion into a second chucking device are performed in a single intermediate stalling and inverting operation. Advantageously, this feature of the invention not only saves considerable auxiliary machinery, but also contributes substantially to the precision of lens processing.

According to another feature of the invention, it is further possible with this method to process the rim of the lens body during each chucking operation In particular, according to another feature, the lens body circumference is processed for subsequent centering in a first chucking position. Therefore, the lens body will be rechucked at its already processed and thus very precise circumference, and consequently may be accurately aligned to the rotation axis of the workpiece spindle. It is thus ensured that during subsequent coarse grinding and precision grinding of the second lens side, the optical axis of this lens surface will again coincide exactly with its geometrical axis.

In a specific embodiment of the invention, controlled movements of the workpiece and the tools towards and away from each other are performed in a single machine in such a way that each side of the lens body is processed first on its face and subsequently on its circumference. According to another feature, a partly processed or finished lens body may be provided with an edge chamfer on at least one side in order to protect the edge, or each edge, of the lens body, respectively.

According to another aspect of the invention, a device for processing optical lenses according to the invention is distinguished by the following features:

a) a machine column is provided with motor drives and guiding means for two vertically displaceable workpiece spindles for a blank of a lens body to be received by them for processing;

b) two tool spindles that are horizontally displaceable in an X axis direction and are slewable at a right angle thereto around a horizontal slewing axis B are associated to the workpiece spindles in variable opposite arrangement;

c) an unloading device that is displaceable perpendicularly to the horizontal slewing axis B is arranged between the tool spindles, and d) a loading device slewable around a further slewing axis C is associated to the unloading device.

It will be appreciated that such a device designed in accordance with the invention permits complete processing, so that only this single machine will be required for coarse grinding and precision grinding of both lens sides, as well as for centering and application of chamfers.

According to another aspect of the invention, the device is preferably designed in such a manner that the slewing axes are parallel to each other and are substantially at right angles to the X axis, whereby a very compact structure is achieved.

According to yet another feature of the inventive apparatus, both workpiece spindles comprise chucking means for the lens body, and particularly may include collets that may be pneumatically or hydraulically operable. Moreover, in accordance with another aspect of the invention, the unloading device as well as the loading device may each comprise chucking means for the lens body and, in particular, may comprise suction chucks. These permit gentle seizing of the lens body so that the delicate lens surface will be protected during the reloading procedure.

In accordance with still a further aspect of the invention the workpiece spindles, on the one hand, and the tool spindles on the other hand, are each independently movable in the direction of a Z axis and the X axis, respectively, each of the tool spindles having an individual slewing B axis. With this embodiment, all four spindles are simultaneously in operation in order to process two lenses at the same time.

Alternatively, another feature of the invention provides that the workpiece spindles are mounted on a feed slide parallel to each other and perpendicularly to the main dimension of the slide. This will permit common movement and consequently saving of a drive. Similarly, according to yet another feature of the invention, the tool spindles may b e mounted on a feed carriage located above the workpiece spindles, which carriage is slewable around the horizontal slewing B axis and holds the two tool spindles at a constant distance above the workpiece spindles. Another feature provides for the distance between the tool spindles to be equal to the distance between the workpiece spindles.

Also advantageous is the further development of the invention, whereby one tool spindle is equipped with a coarse-grinding tool and the other tool spindle is equipped with a precision-grinding tool. According to still another feature, each tool may have a face and a circumferential grinding surface, thus permitting production of the lens contour, processing the circumference in the following operations and—if desired—production of a chamfer for edge protection.

According to the invention, one and the same tool thus serves to implement the entire sequence of operations.

In accordance with a particularly advantageous combination of features, the invention includes:

a) a machine column with motor drives and guiding means for a feed slide and a feed carriage;

b) a feed slide which is vertically displaceable in a Z axis direction and which holds two workpiece spindles each carrying a chucking tool for a lens bland to be held t hereby;

c) a feed carriage which is horizontally displaceable in an X axis direction as well as being slewable around a B axis running substantially at right angles to the main dimension of the feed carriage which supports two tool spindles;

d) the feed carriage holds an unloading device that is displaceable perpendicularly to the main feed carriage dimension;

e) a loading device that is slewable around a horizontal axis C which is arranged between the unloading device and the feed slide; and f) the tool spindles comprise a coarse-grinding and a precision-grinding tool each having a face grinding surface and a circumferential grinding surface.

The structure according to the invention may thus be designed as a fully automatic machine so that no manual intervention will be required as the lens body is processed from the blank to the finished contour. Essential quality features and advantages of the invention result from the fact that the optical axis of each lens side coincides with its geometrical axis so that the optical axes of both lens sides will also coincide.

Further features, details and advantages of the invention will become evident from the wording of the claims as well as from the following description of a preferred embodiment illustrated in the drawing which shows by way of 12 schematic side views the arrangement and use of the device of the invention, elucidating at the same time the sequence of operations of the procedure of the invention. The preferred embodiment of the invention is shown in the drawings simply by way of illustration and not of limitation thereof, showing one of the best modes (and alternative embodiments) suited to carry out the inventive concept.

The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWING

The accompanying drawings, incorporated into and forming a part of the specification, illustrate several aspects of a preferred embodiment of the present invention and, together with the description, serve to explain the principles of the invention. In the drawings.

BEST MODE FOR CARRYING OUT THE INVENTION

Figure 2:
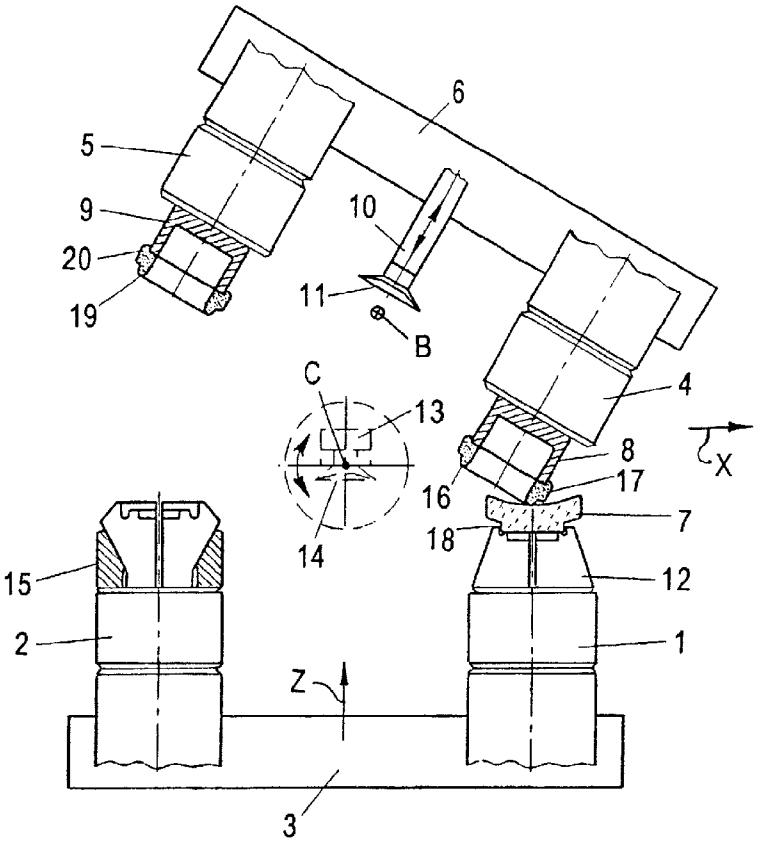
FIGS. 1–5 provide a view of an apparatus according to the invention while performing various steps of the inventive process on one side of a lens body.
Figure 1:
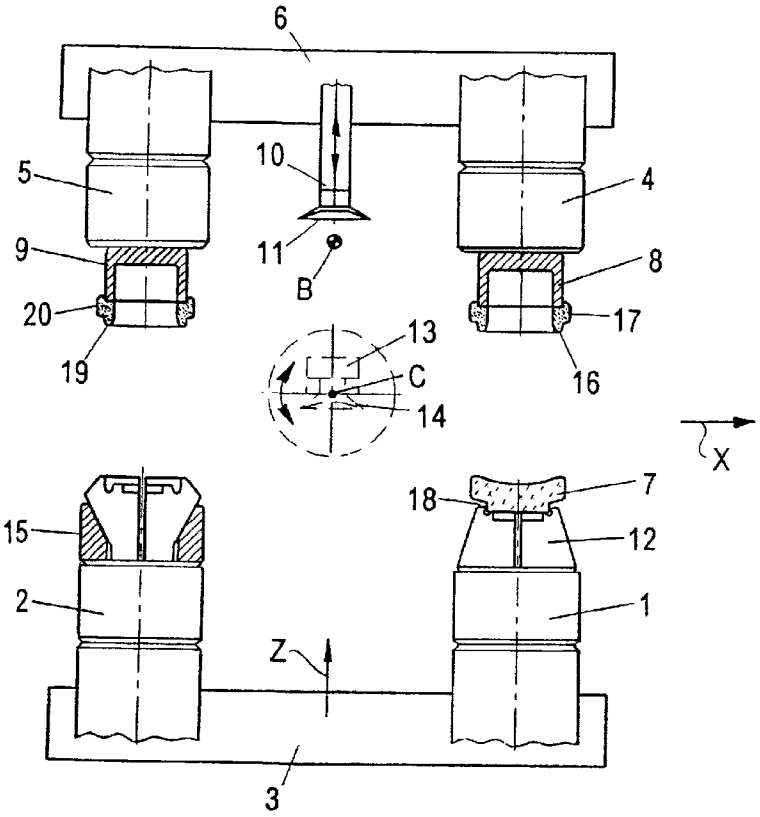

Referring now to the drawings, in the device shown, two workpiece spindles 1 and 2 are fastened to a common feed slide 3 that permits simultaneous movement of the two workpiece spindles 1 and 2 in a vertical direction or Z axis. Two tool spindles 4 and 5 are fastened in a corresponding arrangement, preferably on a common feed carriage 6 that permits simultaneous horizontal movement (in the X axis direction). The feed carriage 6 and the connected tool spindles 4 and 5 have a common B axis around which the feed carriage 6 together with the tool spindles 4 and 5 can be slewed in either rotational direction.

The blanks used for each lens body (7) include a chucking extension (18), making it possible to use a single apparatus to implement the process of forming the lens bodies according to the invention.

The apparatus used to make the lens bodies includes a pair of workpiece spindles (1) and (2), as well as a pair of tool spindles (4) and (5). As seen in the drawing figures, tool spindles (4) and (5) respectively have coarse tool (8) and finishing tool (9) thereon. Additionally, the illustrated apparatus includes an unloading device (10) and a loading device (13), which take the lens S/B lens body (7) when processed on one side, from a chucking tool (12) of tool spindle (1).

These devices turn the lens body (7) around for centered insertion in its inverted position into a chucking tool (15) of the tool spindle (2) for further processing. The workpiece spindles (1) and (2) may be mounted parallel to each other on a horizontally displaceable and vertically adjustable feed slide (3). A feed carriage (6) may displace and slew the tool spindles (4) and (5) together with the unloading device (10) around a horizontal B axis. The loading device (13) is slewable around a further horizontal axis (C) between the workpiece spindles (1) and (2) and the tool spindles (4) and (5).

Figure 10:
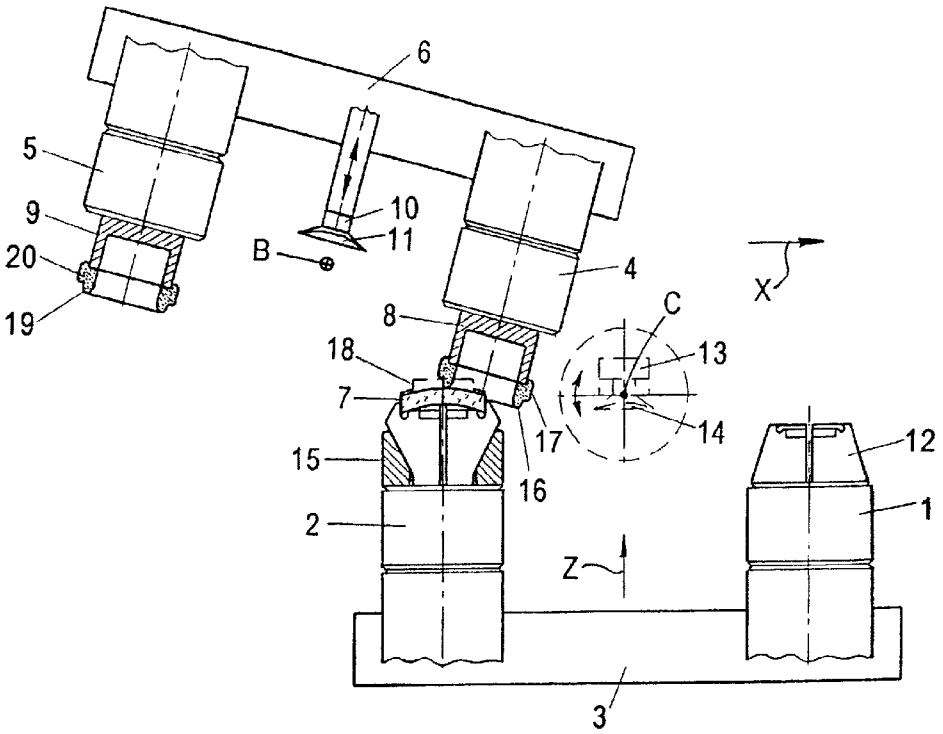
FIGS. 9–12 illustrate the inventive apparatus while implementing the additional steps on the other side of the lens body, including removal of the chucking extension therefrom.
Figure 9:
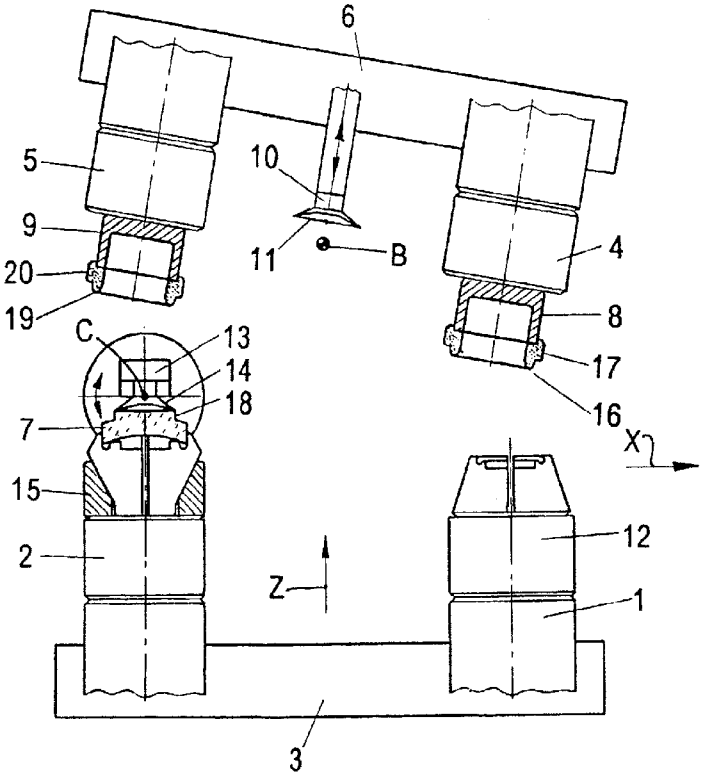
Figure 12:
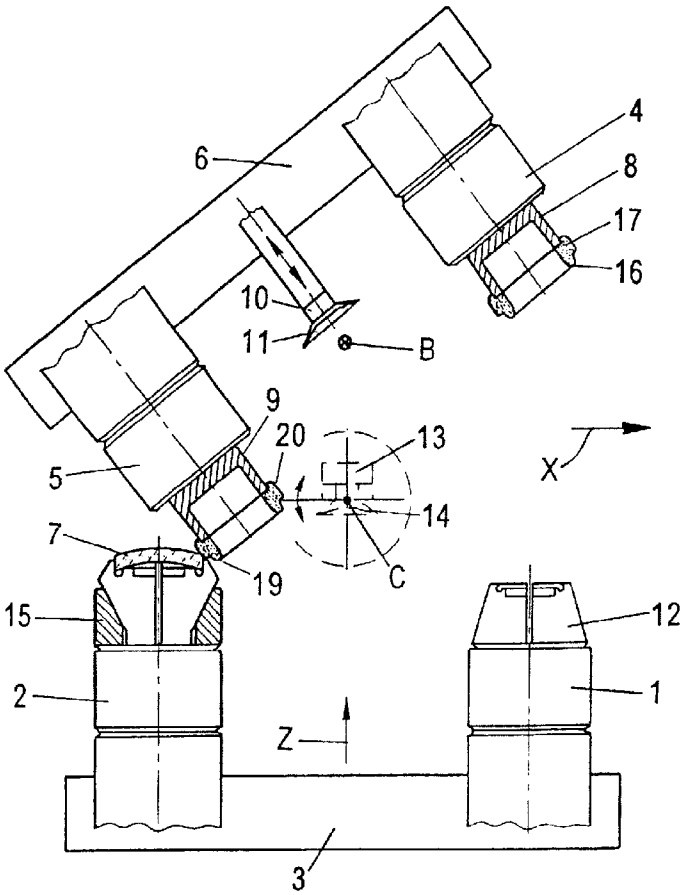
Figure 11:
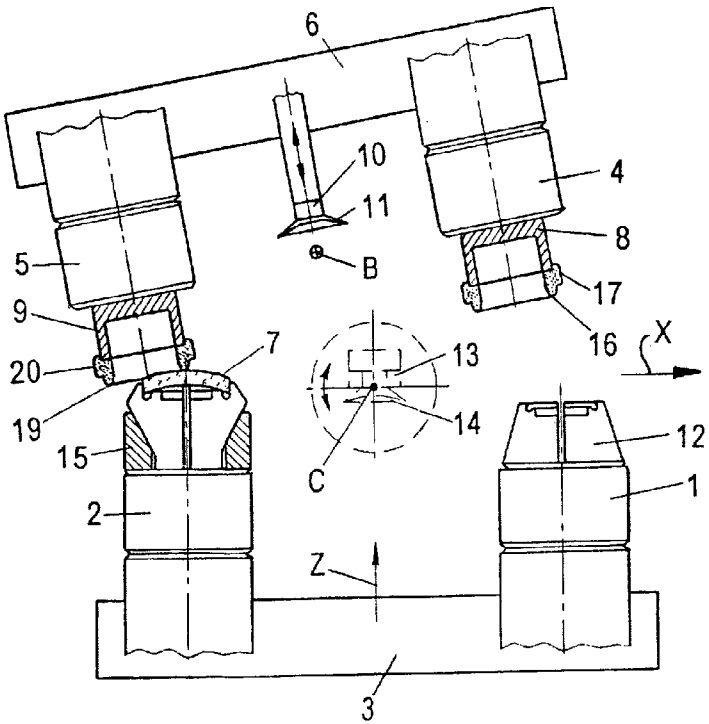

In operation, in a method of processing optical lenses a blank of a lens body (7) is chucked and provided with a predefined contour by coarse and finishing tools (8) and (9) through grinding and polishing operations illustrated in FIGS. 2–12. As shown therein, a lens body is provided with a chucking extension (18) which permits and requires that only a single chucking operation be performed on the blank. As shown in FIG. 10, the chucking extension (18) is removed at the end of the process.

The chucking extension (18) is, for example, a few millimeters in height on one side of the lens body, which is thus set off to be noticeably smaller in diameter than the overall outer diameter of the lens body.

Figures 3, 4:
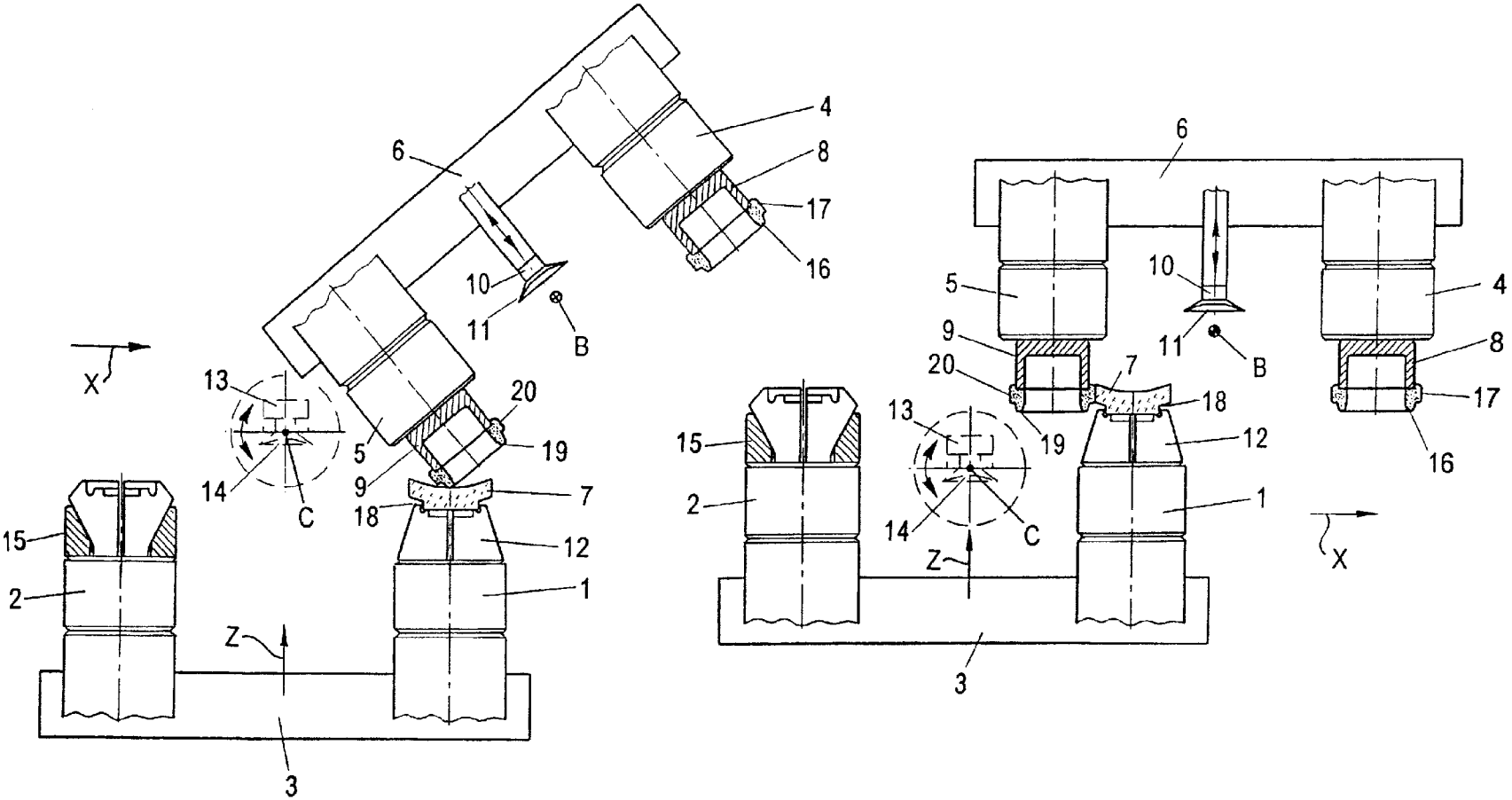
Figure 6:
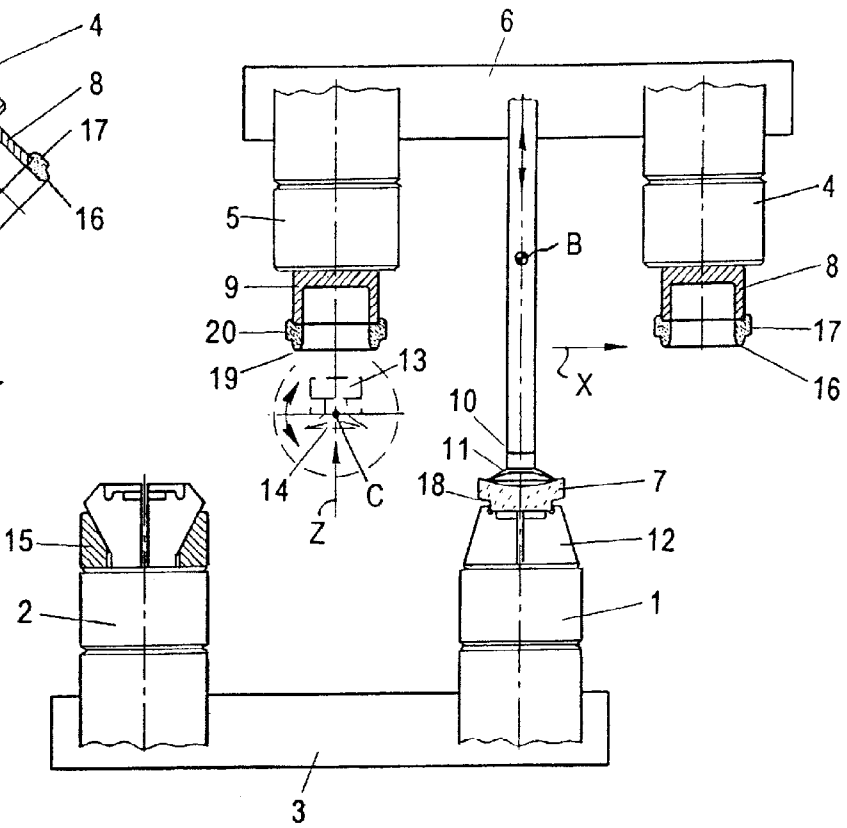
FIGS. 6–8 show the inventive apparatus while implementing steps of transitioning the blank of the lens body to permit additional steps to be performed on the other side of the lens body.
Figure 5:
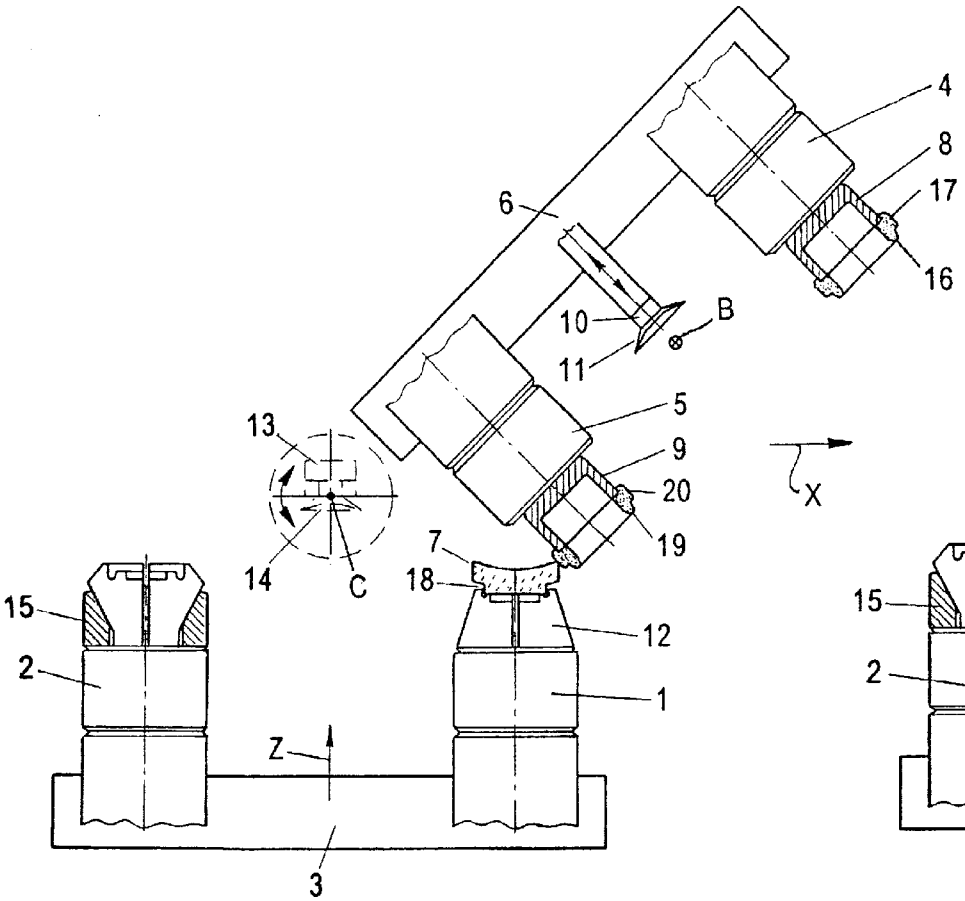
Figure 8:
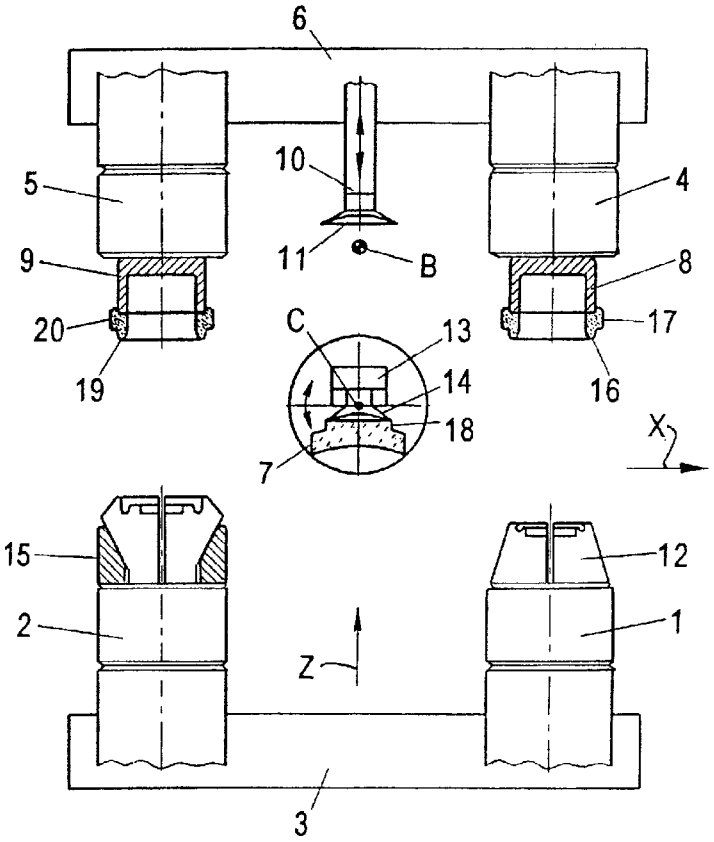
Figure 7:
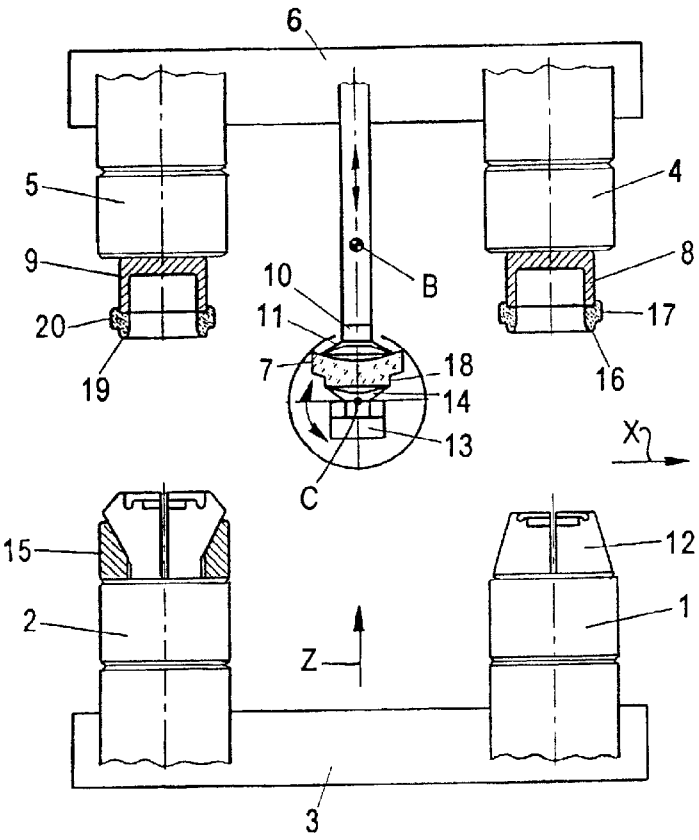

In accordance with another feature of the invention, the rim of the lens may be processed during each chucking operation. In particular, as shown in FIG. 4 for example, the lens body circumference is processed for subsequent centering in a first chucking position. Therefore, the lens body will be rechucked at its already processed and thus very precise circumference, and consequently may be accurately aligned to the rotation axis of the workpiece spindle. According to another feature, as appreciated from FIG. 5, a partly processed or finished lens body may be provided with an edge chamfer on at least one side in order to protect the edge, or each edge, of the lens body, respectively.

As shown in the drawings, an unloading device (10) which is displaceable perpendicularly to a horizontal slewing axis B, is arranged between the tool spindles, and a loading device (13), which is slewable around a further slewing axis C, is associated to the unloading device. The unloading device (10) as well as the loading device (13) may each comprise chucking means for the lens body and, in particular, may comprise suction chucks (11) and (14). These suction chucks permit gentle seizing of the lens body so that the delicate lens surface will be protected during the reloading procedure.

The drawings further show that the tool spindles 4, 5 comprise a coarse-grinding tool 8 and a precision-grinding tool 9, each having a face grinding surface 16, 19 and a circumferential grinding surface 17, 20.

In a modified device not described in detail herein, it is also possible that the workpiece spindles 1 and 2 are guided by separate feeding devices, whereby they can be moved in the direction of the Z axis independently of each other. The same applies to the tool spindles 4 and 5, which may also be guided by separate feeding devices and consequently mal be moved in the direction of the X axis independently of each other. A separate B axis that is perpendicular to the X axis may also be provided for each of the tool spindles 4 and 5 so that each of these spindles may be slewed separately around a B axis.

I claim:

1. A method of processing optical lenses comprising the steps of:

performing a single chucking operation on a blank of a lens body, said blank having a chucking extension to permit said single chucking operation to enable performing both a coarse grinding and a finishing grinding of said lens body;

providing said lens body with a predefined contour by using a coarse tool to perform a coarse grinding step on said blank chucked by said single chucking operation and using a finishing tool to perform a finishing step on said blank chucked by said single chucking operation, and removing said chucking extension from said blank, wherein said step of providing said lens body with a predefined contour comprises:

performing said coarse processing and said finishing of the lens body on a front side of said lens body while said chucking extension of said blank is chucked in a single chucked position during said single chucking operation;

turning said chucked blank around, and processing a back side of said lens body while said chucking extension said blank remains chucked in said single chucked position.

2. A method of processing optical lenses comprising the steps of:

performing a single chucking operation on a blank of a lens body, said blank having a chucking extension to permit said single chucking operation to enable performing both a coarse grinding and a finishing grinding of said lens body;

providing said lens body with a predefined contour by using a coarse tool to perform a coarse grinding step on said blank chucked by said single chucking operation and using a finishing tool to perform a finishing step on said blank chucked by said single chucking operation, and removing said chucking extension from said blank, further comprising performing the steps of unloading from a first chuck and insertion into a second chuck in a single stalling and inverting operation.

3. A method of processing optical lenses comprising the steps of:

performing a single chucking operation on a blank of a lens body, said blank having a chucking extension to permit said single chucking operation to enable performing both a coarse grinding and a finishing grinding of said lens body;

providing said lens body with a predefined contour by using a coarse tool to perform a coarse grinding step on said blank chucked by said single chucking operation and using a finishing tool to perform a finishing step on said blank chucked by said single chucking operation, and removing said chucking extension from said blank, comprising the further steps of performing movement of the blank of said lens body and said coarse and finishing tools toward each other and away from each other in a controlled manner in a single device, and wherein, on either side of said lens body, said lens body is processed first on a face portion and then on a circumferential portion thereof.

4. A method according to claim 3, comprising the further step of providing an edge chamfer on at least one side of a partly processed or finished lens body.

5. A method of processing optical lenses comprising the steps of:

providing a machine with motor drives and guiding means for a feed slide and for a feed carriage which supports two tool spindles, arranging the feed slide for vertical displacement in a Z-axis direction and providing two workpiece spindles thereon with respective chucking tools for receiving respective blanks of a lens body, arranging the feed carriage for horizontal displacement in an X-axis direction and for slewing perpendicularly to the main dimension of the feed carriage around a further horizontal axis, arranging an unloading device for displacement on the feed carriage perpendicularly to the main dimension of the feed carriage, arranging a loading device for slewing around another horizontal axis between the unloading device and the feed slide, and providing respective tools, each having a face grinding surface and a circumferential grinding surface, on the respective tool spindles; and coarse grinding and precision grinding a respective lens body blank using a respective tool on a respective tool spindle.

6. A method according to claim 5, further comprising the steps of:

vertically displacing said feed slide in the Z-axis direction;

providing a blank of a lens body to at least one of the chucking tools of the workpiece spindles;

horizontally displacing the feed carriage in the X-axis direction;

slewing the feed carriage around the further horizontal axis;

displacing the unloading device perpendicularly to the main dimension of the feed carriage; and slewing the loading device around said another horizontal axis between the unloading device and the feed slide.

7. A method of processing optical lenses comprising the steps of:

providing a lens blank including a chucking extension extending from a first surface thereof for gripping by a chuck during grinding processing of the lens blank;

chucking said extension in a chucking tool;

processing a periphery of said lens blank for subsequent centering of the lens blank, performing both a coarse grinding and a finishing grinding of a second surface of said lens blank in a single operation while said extension is chucked in the chucking tool, said second surface being opposite said first surface of the lens blank;

said single operation including the steps of:

performing a coarse grinding step on said second surface while said extension of said lens blank is chucked in the chucking tool, and performing a finishing step on said second surface while said extension of said lens blank is chucked in the chucking tool, comprising the further steps of:

after said single operation, gripping the lens blank by a second chucking tool and, while the lens blank is gripped in the second chucking tool, performing both a coarse grinding and a finishing grinding of the first surface of said lens blank in another single operation;

said another single operation including the steps of:

performing a coarse grinding step on said first surface, and performing a finishing step on said first surface.

8. A method according to claim 7, wherein said step of performing a coarse grinding step in said another single operation includes a step of removing said chucking extension from said first surface of said lens blank.

9. A method according to claim 7, wherein said step of gripping the lens blank by a second chucking tool comprises the step of gripping the periphery of the lens blank by said second chucking tool, after previously processing the periphery for subsequent centering.

10. A method according to claim 9, comprising the further step of grinding the lens blank to remove said chucking extension while said lens blank is gripped at the periphery thereof by said second chucking tool.

11. A method of processing optical lenses comprising the steps of:

providing a lens blank having a preformed shape including a one piece integral structure with an integrally formed chucking extension extending from a first surface of said one piece structure for gripping by a chuck during grinding processing of the lens blank;

chucking said extension in a chucking tool;

processing a periphery of said lens blank for subsequent centering of the lens blank, performing both a coarse grinding and a finishing grinding of a second surface of said lens blank in a single operation while said extension is chucked in the chucking tool, said second surface being opposite said first surface of the lens blank;

said single operation including the steps of:

performing a coarse grinding step on said second surface while said extension of said lens blank is chucked in the chucking tool, and performing a finishing step on said second surface while said extension of said lens blank is chucked in the chucking tool, comprising the further step of removing said chucking extension from said first surface of said lens blank by grinding said first surface.

12. A method of processing optical lenses comprising the steps of:

performing a single chucking operation on a chucking extension integrally formed with a blank of a lens body including said chucking extension in a one piece gaplessly continuous structure, said single chucking operation on said chucking extension enabling performing both a coarse grinding and a finishing grinding of said lens body;

providing said lens body with a predefined contour by using a coarse tool to perform a coarse grinding step on said blank chucked by said single chucking operation and using a finishing tool to perform a finishing step on said blank chucked by said single chucking operation, and removing said chucking extension from said blank, wherein said step of removing said chucking extension from said blank comprises grinding said blank to remove said chucking extension therefrom.

13. A method according to claim 12, further comprising the step of chamfering the lens blank by processing a respective edge of said lens blank while said chucking extension of said lens blank is chucked in the chucking tool.

14. A method according to claim 12, wherein said chucking extension is integrally formed on a first surface of said blank.

* * * * *